United States Patent [19]

Trine

[11] 3,949,337

[45] Apr. 6, 1976

[54] SELF-INDUCTION DEVICE FOR GENERATING HARMONICS

[75] Inventor: Joseph Trine, Oupeye, Belgium

[73] Assignee: Elphiac, Charleroi, Belgium

[22] Filed: Nov. 25, 1974

[21] Appl. No.: 526,948

[30] Foreign Application Priority Data

Nov. 28, 1973 Belgium ..... 5536

[52] U.S. Cl. ..... 336/60; 336/92; 336/180; 336/192; 336/212

[51] Int. Cl.[2] ..... H01F 27/10

[58] Field of Search ..... 336/60, 58, 55, 90, 92, 336/94, 212, 192, 229, 180, 145, 146, 147

[56] References Cited

UNITED STATES PATENTS

| | | | |
|---|---|---|---|
| 730,785 | 6/1903 | Muller | 336/60 X |
| 2,632,041 | 3/1953 | Bilodeau | 336/60 X |
| 3,274,526 | 9/1966 | Emanuelson | 336/60 |
| 3,451,023 | 6/1969 | Aveyard et al. | 336/229 X |
| 3,454,916 | 7/1969 | Hoover | 336/60 |
| 3,541,424 | 11/1970 | Tada et al. | 336/60 X |
| 3,548,354 | 12/1970 | Schwab | 336/60 X |
| 3,691,492 | 9/1972 | Muller | 336/60 |
| 3,818,400 | 6/1974 | Linnent et al. | 336/94 |

FOREIGN PATENTS OR APPLICATIONS

| | | | |
|---|---|---|---|
| 877,137 | 11/1942 | France | 336/60 |

*Primary Examiner*—Thomas J. Kozma
*Attorney, Agent, or Firm*—Raymond A. Robic; Arthur Schwartz; Louis Allahut

[57] ABSTRACT

The present invention relates to a self-induction device capable of steep saturation when the instantaneous value of a current flowing therethrough goes beyond a given level. The device comprises an annular magnetic core including at least one toroid coil of magnetic material, an insulating structure for supporting the coils and at least one insulated conductor coil embracing a section of said magnetic core. A tank encloses the core and the coils, the tank being provided with at least one input conduit for feeding a refrigerating fluid to the core and of at least one output conduit for the fluid. The insulated conductor coil is constituted of an insulated flexible cable wound around the insulating structure. The extremities of each conductor coil are so connected with the other conductor coils to effect a desired coupling, the so coupled coils being connected to an utility circuit.

6 Claims, 3 Drawing Figures

SELF-INDUCTION DEVICE FOR GENERATING HARMONICS

The present invention relates to a self-induction device of the steep saturation type for producing harmonic frequencies from a base frequency, and may be referred to as a frequency multiplier device.

More particularly, the present invention concerns an improved arrangement of a steep saturation self-induction device the magnetic core of which may be excited, when saturated, by frequencies of about 1khz for producing harmonics of about 5khz.

The self-induction device in accordance with the present invention, which device is capable of steep saturation when the instantaneous value of a current flowing therethrough goes beyond a given level, is generally characterized by a ring-shaped or annular magnetic core made up of one or more toroid coils of magnetic material, an insulating structure for supporting the toroid coils, at least one insulated conductor coil covering a section of the magnetic core, and a tank enclosing the core and coil unit, the tank being provided with at least one input main conduit for a refrigerating fluid flowing towards the core and with at least one output conduit for this same fluid.

Figure 1:
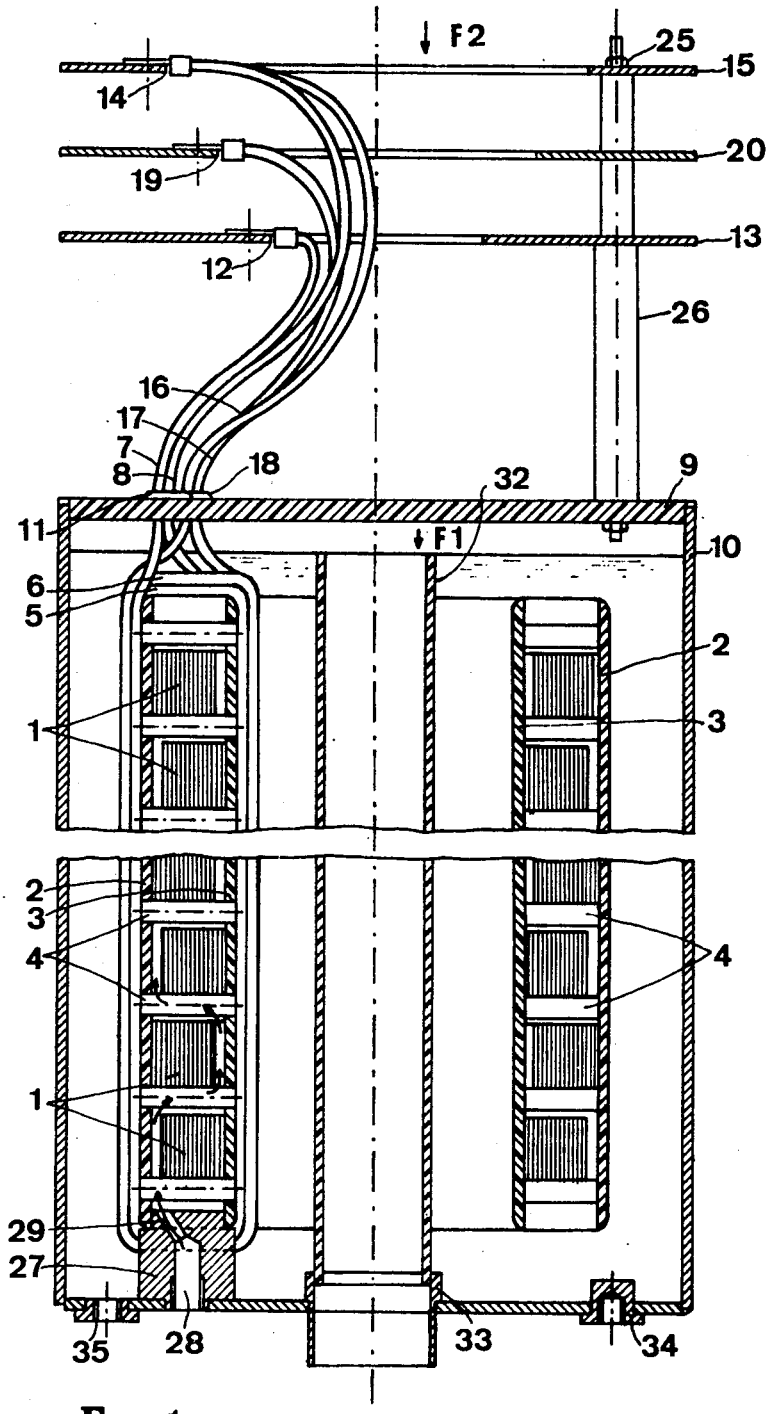
Figure 2:
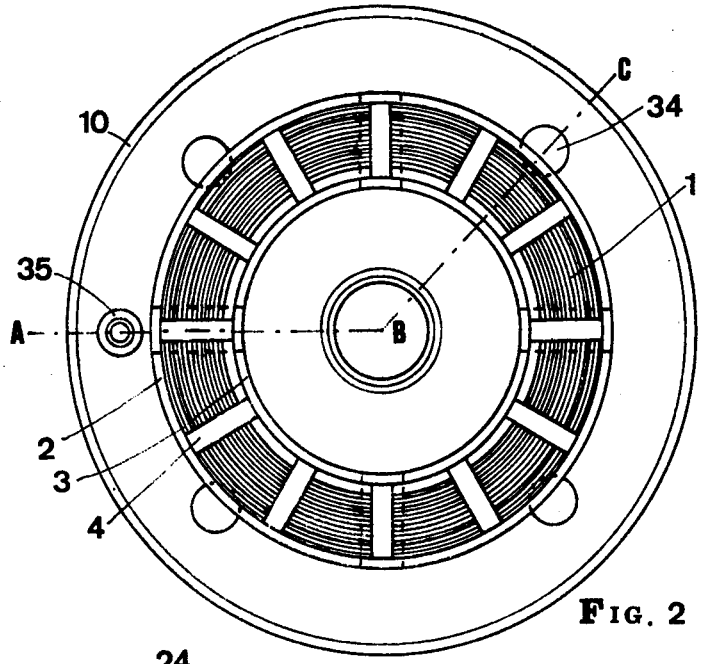
Figure 3:
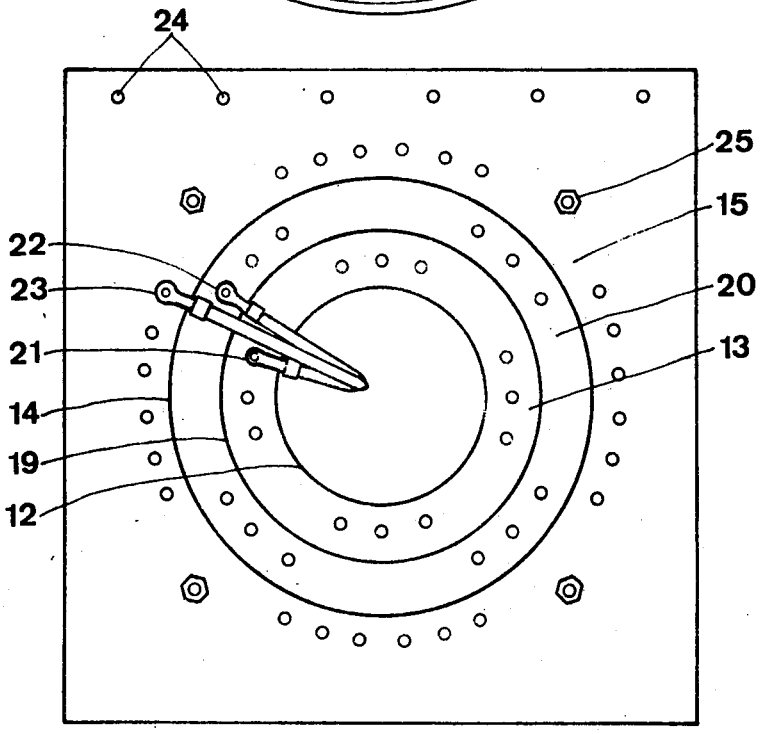

A preferred embodiment of the present invention will be hereinafter described with reference to the accompanying drawings, wherein FIG. 1 is a vertical sectional view taken along line A—B—C of FIG. 2 and illustrates a self-induction device arrangement in accordance with the present invention;

FIG. 2 is a plan view of the device shown in FIG. 1 as seen from the arrow F1 appearing on FIG. 1, the coils and connections not being illustrated therein; and FIG. 3 is a plan view of the device shown in FIG. 1 as seen following the arrow designated F2 at the top of FIG. 1.

The following description will generally refer to FIGS. 1, 2 and 3 wherein like numeral references designate like elements.

The several toroid coils constituting the magnetic core of the self-induction device are identical in structure, each having a rectangular cross-section 1 and fabricated by winding flat on a circular chuck a continuous band of a particular magnetic steel material having a low leakage and presenting a substantially rectangular hysteresis loop.

The insulating structure supporting the toroid coils consists of two concentric tubes 2 and 3 made of an insulating material one being exterially and the other interially mounted. This structure also includes radial spacers 4 made of insulating material for supporting the toroid coils as well as for providing a space between two coils for the circulation of a refrigerating fluid.

The self-induction device winding is characterized by an even number of conductor coils having the same number of turns and evenly distributed around the annular magnetic core. These conductor coils consist of insulated flexible cables wound around the supporting tubes 2 and 3 so as to contact a section of the magnetic core constituted by a set of toroid coils 1. For sake of clarity, there is illustrated on FIG. 1 just one pair of coils 5 and 6 wound one upon the other and located within an angle of 30° of the annular magnetic circuit adjacent to the plane A—B of FIG. 2.

The input 7 and the output 8 of the conductor coil 5 extend through the cover 9 of the tank 10 through a cable-hole 11 and are respectively connected to terminals provided at the edge 12 of a circular opening made in the metallic plate 13 and at the edge 14 of a circular opening made in a second metallic plate 15. Similarly, the input 16 and the output 17 of the conductor coil 6 are connected through a cable-hole 18 to terminals provided at the edge 14 of the circular opening of the plate 15 and at the edge 19 of a circular opening of a third metallic plate 20, respectively. Thus, the path of the coil 5 runs from the plate 13 to the plate 15, the latter being the starting point for coil 6 which runs to the plate 20. Therefore, the conductor coils 5 and 7 are serially connected to the plates 13 and 20 which stand as terminal points of one self-induction element whereas the plate 15 acts as a center tap. All the pairs of coils, evenly distributed around the annular magnetic core, are connected in the same fashion. The connecting terminals are therefore spred along the edges of the coaxial openings 12, 19 and 14 of increasing diameter, which openings are made in the plates 13, 20 and 15 respectively at three superposed levels.

FIG. 3 is a top view as per the arrow F2 indicated in FIG. 1 and show three cables 21, 22 and 23 respectively connected to the plate 13, 20 and 15 and also shown the openings provided in these plates for the connection of all the cables required. As illustrated, for 12 pairs of coils, there are provided 12 openings in plate 13, 12 openings in plate 20 and 24 openings in plate 15. The plates 13 and 20 therefore constitute the extreme terminals and the plate 15 the center tap of a self-induction device made of two halves, each being constituted of 12 coils in parallel.

Also shown in FIG. 3, there is a series of holes 24 drilled in the terminal plates for connecting the same to the utility circuit. There are also illustrated four tightening screws 25 for four sets of spacers and insulating tightening rods supporting the three terminal plates on the cover 9 of the tank. One of those sets is designated under 26 in FIG. 1.

FIG. 1 also shows the path followed by a refrigerating fluid, such as water. The fluid is fed by means of four flexible pipes (not shown) through four holes drilled in four blocks welded to the bottom of the tank. These blocks are also used to support and centralize the tubes 2 and 3 so that the lower part of the coils may stand at a certain height above the tank bottom. The blocks are shown in FIG. 2 by dash lines and at an angle of 90° one with another, whereas a cross section of one of the blocks is shown under 27 in FIG. 1. From the input opening 28, the fluid is driven through the conduit 29 between the two supporting tubes 2 and 3 and thereafter follows a path indicated by the several arrows. Thus, the liquid is forced to alternatively hug the external and internal cylindrical sides of the successive toroid coils constituting the magnetic core, and to flow alternatively from the outside to the inside and from the inside to the outside through the space defined between the horizontal sides of the coils. This path is achieved owing to alternate toroid coils having the same radial width but having an internal diameter equal to the external diameter of the internal supporting tube 3 and having an external diameter equal to the internal diameter of the external supporting tube 2.

The refrigerating fluid is evacuated through a conduit 32 made of insulating material and located at the center of the tank. The upper extremity of conduit 32 goes beyond the core and coil unit and its lower extremity is encased in a sleeve 33 extending under the tank and to which is connected a flexible pipe (not shown) for draining off the fluid. It is to be mentioned that there is enough space under the tank for housing the input and output pipes since the tank itself is supported by a set of insulators (not shown) which are screwed into sleeves therefore provided at the bottom of the tank. These sleeves are shown in FIG. 2 under the reference 34, the cross-section of one being shown in FIG. 1. The numeral reference 35 desigantes a sleeve for drain-cork.

Therefore, the above described embodiment constitutes a substantial improvement in self-induction devices containing a certain number of pairs of coils coupled in series-parallel and allows the use of a center tap. The same arrangement of the magnetic core and the windings may be used for any desired coupling of several coils or for a single coil by keeping or not, as the case may be, the arrangement of terminals made up of terminal plates provided with coaxial openings at superposed horizontal levels.

For example, in the case where the use and the electric characteristic would require a plurality of coils connected in parallel without a center tap, the terminals could be arranged onto circular areas of conductors connected at regular intervals along the edges of two circular and coaxial openings provided two electrically conductive plates located at two superposed levels.

Moreover, if the diameter of the central conduit is too great as to permit the connection of flexible pipes, the draining of the fluid may be achieved through several tubes of a smaller diameter and encased in several sleeves suitably distributed at the bottom of the tank.

I claim:

1. A self-induction device capable of steep saturation when the instantaneous value of a current flowing therethrough goes beyond a given threshold value, comprising an annular magnetic core including a plurality of toroid coils of magnetic material, each of said toroid coils having the same radial width, two concentric tubes of insulating material, one of said tubes being at the inside and the other of said tubes being at the outside of said core, each second toroid coil having an internal diameter equal to the external diameter of the internal tube, each other second coil having an external diameter equal to the internal diameter of the external tube, insulating radial spacers inserted between said tubes for supporting said toroid coils and for defining a space through which flows a refrigerating fluid, said fluid flowing alternately along the external and internal sides of the toroid coils and through the space provided between the horizontal sides of said toroid coils by said spacers, at least one insulated conductor coil embracing said annular magnetic core, a tank enclosing said magnetic core and said conductor coil, said tank being provided with at least one input conduit for feeding said refrigerating fluid to said space and at least one output conduit for said fluid.

2. A device as claimed in claim 1, characterized in that the toroid coils making up the magnetic core are bands of magnetic steel material of low leakage and having a substantially rectangular hysteresis loop characteristic.

3. A device as claimed in claim 1, including a plurality of said insulated conductor coils, each of said conductor coils having the same number of turns, said conductor coils being evenly distributed around the magnetic core, the extremities of the conductor coils extending through an insulating cover closing the tank, and said conductor coils being connected to terminals provided at the edges of two superposed horizontal metallic plates having coaxial circular openings, said plates constituting two connection terminals of said device when all the conductor coils are connected in parallel.

4. A device as claimed in claim 1, including a plurality of said insulated conductor coils, said plurality being an even number of conductor coils, each of said conductor coils having the same number of turns, said conductor coils being distributed at regular intervals around the magnetic core, the extremities of the coils extending through an insulating cover covering the tank and being connected to terminals provided at the edges of three coaxial openings made in three superposed horizontal metallic plates, one of said plates constituting a center tap and the other two plates constituting the extreme terminals for said device, each half of the total number of conductor coils being connected in parallel between said center tap and one of said extreme terminals.

5. A device as claimed in claim 1, wherein in that the output conduit for the refrigerating fluid is at the center of the tank and of a height beyond that of said core and coils, the refrigerating fluid being drained off through the bottom of the tank.

6. A device as claimed in claim 5, wherein the refrigerating fluid is water.

* * * * *